US006806803B2

(12) United States Patent
Hopkinson et al.

(10) Patent No.: US 6,806,803 B2
(45) Date of Patent: Oct. 19, 2004

(54) TRANSFORMER WINDING

(75) Inventors: Philip J. Hopkinson, Charlotte, NC (US); Dilip R. Purohit, Charlotte, NC (US); Gary D. King, Laurel, MS (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 10/313,547

(22) Filed: Dec. 6, 2002

(65) Prior Publication Data

US 2004/0108926 A1 Jun. 10, 2004

(51) Int. Cl.[7] ..... H01F 27/06

(52) U.S. Cl. ..... 336/67; 336/65; 336/5; 336/12

(58) Field of Search ..... 336/5, 12, 10, 336/65, 67, 90, 92, 206, 208, 198, 192

(56) References Cited

U.S. PATENT DOCUMENTS 3,760,314 A * 9/1973 Krasienko et al. ..... 336/192
4,173,747 A * 11/1979 Grimes et al. ..... 336/60
4,338,657 A * 7/1982 Lisin et al. ..... 363/68
4,678,986 A 7/1987 Barthelemy
4,857,878 A * 8/1989 Eng et al. ..... 336/192
4,916,363 A * 4/1990 Burton et al. ..... 315/276
5,015,984 A * 5/1991 Vialaneix ..... 336/197
5,404,123 A * 4/1995 Joseph ..... 336/192
5,461,772 A * 10/1995 Puri ..... 29/605
5,583,732 A 12/1996 Seymour et al.
5,774,320 A 6/1998 Seymour et al.
6,650,219 B1 * 11/2003 Widiger et al. ..... 336/198

* cited by examiner

*Primary Examiner*—Anh Mai

(57) ABSTRACT

An electrical transformer is disclosed. The electrical transformer comprises a central axis, a first modular section, and a second modular section. The first modular section is positioned about the central axis and comprises a first support, a first winding of a conductive element, and a first insulating material. The first winding of a conductive element is located about the first support. The first insulating material covers a portion of the first modular section. The second modular section is axially aligned with the first modular section and electrically connected to the first modular section. The second modular section comprises a second support, a second winding of a conductive element, and a second insulating material. The second winding of a conductive element is located about the second support. The second insulating material covers a portion of the second modular section.

37 Claims, 3 Drawing Sheets

TRANSFORMER WINDING

TECHNICAL FIELD

The present invention relates generally to transformers and, more particularly, to transformer windings and processes for producing a modular section foil coil for cast resin windings.

BACKGROUND OF THE INVENTION

Transformers are used extensively in electrical and electronic applications. Transformers are useful to step voltages up or down, to couple signal energy from one stage to another, and for impedance matching. Transformers are also useful for sensing current and powering electronic trip units for circuit interrupters such as circuit breakers and other electrical distribution devices. Generally, the transformer is used to transfer electric energy from one circuit to another circuit using magnetic induction.

A transformer includes two or more multi-turned coils of wire placed in close proximity to cause a magnetic field of one coil to link to a magnetic field of the other coil. Most transformers have a primary winding and a secondary winding. By varying the number of turns contained in the primary winding with respect to the number of turns contained in the secondary winding, the output voltage of the transformer can be easily increased or decreased.

The magnetic field generated by the current in the primary coil or winding may be greatly concentrated by providing a core of magnetic material on which the primary and secondary coils are wound. This increases the inductance of the primary and secondary coils so that a smaller number of turns may be used. A closed core having a continuous magnetic path also ensures that practically all of the magnetic field established by the current in the primary coil will be induced in the secondary coil.

When an alternating voltage is applied to the primary winding, an alternating current flows, limited in value by the inductance of the winding. This magnetizing current produces an alternating magnetomotive force which creates an alternating magnetic flux. The flux is constrained within the magnetic core of the transformer and induces voltage in the linked secondary winding, which, if it is connected to an electrical load, produces an alternating current. This secondary load current then produces its own magnetomotive force and creates a further alternating flux which links back with the primary winding. A load current then flows in the primary winding of sufficient magnitude to balance the magnetomotive force produced by the secondary load current. Thus, the primary winding carries both magnetizing and load current, the secondary winding carries load current, and the magnetic core carries only the flux produced by the magnetizing current.

Disk-type high voltage windings are quite popular in vacuum/pressure impregnated open wound transformers. The disk conductors are supported within cut combs which are symmetrically placed approximately 4" apart around the circumference of the winding mandrel. Each winding disk is electrically connected to an adjacent winding disk using start-to-finish connections. Disk windings require at least ½" to ¾" disk-to-disk space for mechanical reasons for routing the disk-to-disk connections. Generally, the number of disks used in a winding is kept to a minimum in order to minimize the labor cost of the winding.

The use of disk type high voltage cast windings using foil-type conductors is becoming popular in dry type transformers. This type of winding configuration is cost efficient because it is easily produced on an automated winding machine. Typically, disks wound with strip conductors have not been utilized in dry type vacuum/pressure impregnated (VPI) open-wound windings. When disk type windings are used in VPI open-wound designs, they are usually configured with a plurality of disks which are wound using a rectangular cross-section conductor. These windings typically comprise a rectangular conductive element.

SUMMARY OF THE INVENTION

The present invention is directed to a transformer comprising modular sections, each modular section comprising a disk winding. The transformer comprises a winding structure including high voltage modular sections.

Each modular section is positioned about a central axis. The modular sections generally comprise a support and a winding. The support is positioned about the central axis and the winding comprises a conductive element located about the support. The winding may be wound about the support, or alternatively, the winding can be wound separately prior to being positioned about the support and encapsulated with epoxy.

The support comprises an inner supporting ring, an outer supporting ring, and spacer supports. The inner supporting ring is radially spaced from the outer supporting ring by the spacer supports. Radial air ducts are formed between the space between the inner supporting ring and the outer supporting ring.

The support comprises an insulating material, for example the dielectric material used to vacuum pressure impregnate, encapsulate, and seal the coils, cardboard, or any other rigid or semirigid insulting material. The support can be implemented during winding of the conductive element or added later and primarily formed by the baked and hardened dielectric material.

The winding comprises an inner segment and an outer segment. The inner segment is located about the inner supporting ring. Similarly, the outer segment is located about the outer supporting ring. The winding is terminated at an electrical coupling. The electrical coupling removably connects one modular section to another modular section.

The electrical coupling is generally a plug-in type connector. The electrical coupling is located on an upper surface of the modular section. Another electrical coupling is located on a lower surface. The couplings are adapted to be operatively connectable with one another when the upper surface of one modular section is placed adjacent the lower surface of another modular section.

Each modular section further comprises a means for properly aligning adjacent modular sections. When in proper alignment, the modular sections are axially aligned along the central axis. Each modular section includes a key member that extends outwardly from the upper surface. The lower surface of the modular section includes a corresponding key receiver which is adapted to receive the key member to properly align the modular sections.

Other features and advantages of the invention will be apparent from the following specification taken in conjunction with the following drawings.

DETAILED DESCRIPTION OF THE PREFERRED EMBODIMENT

Figure 1:
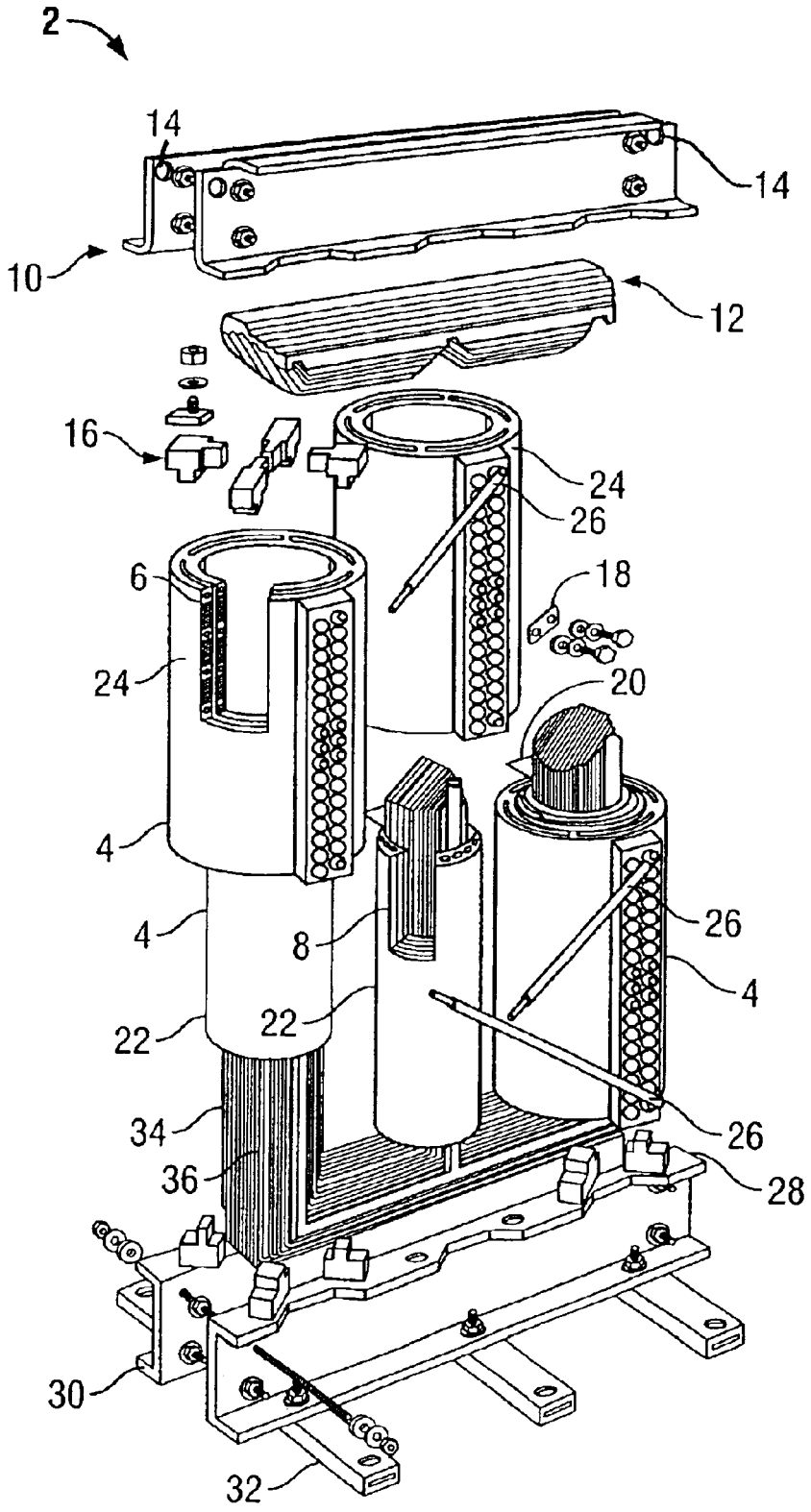
FIG. 1 is an exploded perspective view of a cast coil transformer.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 2:
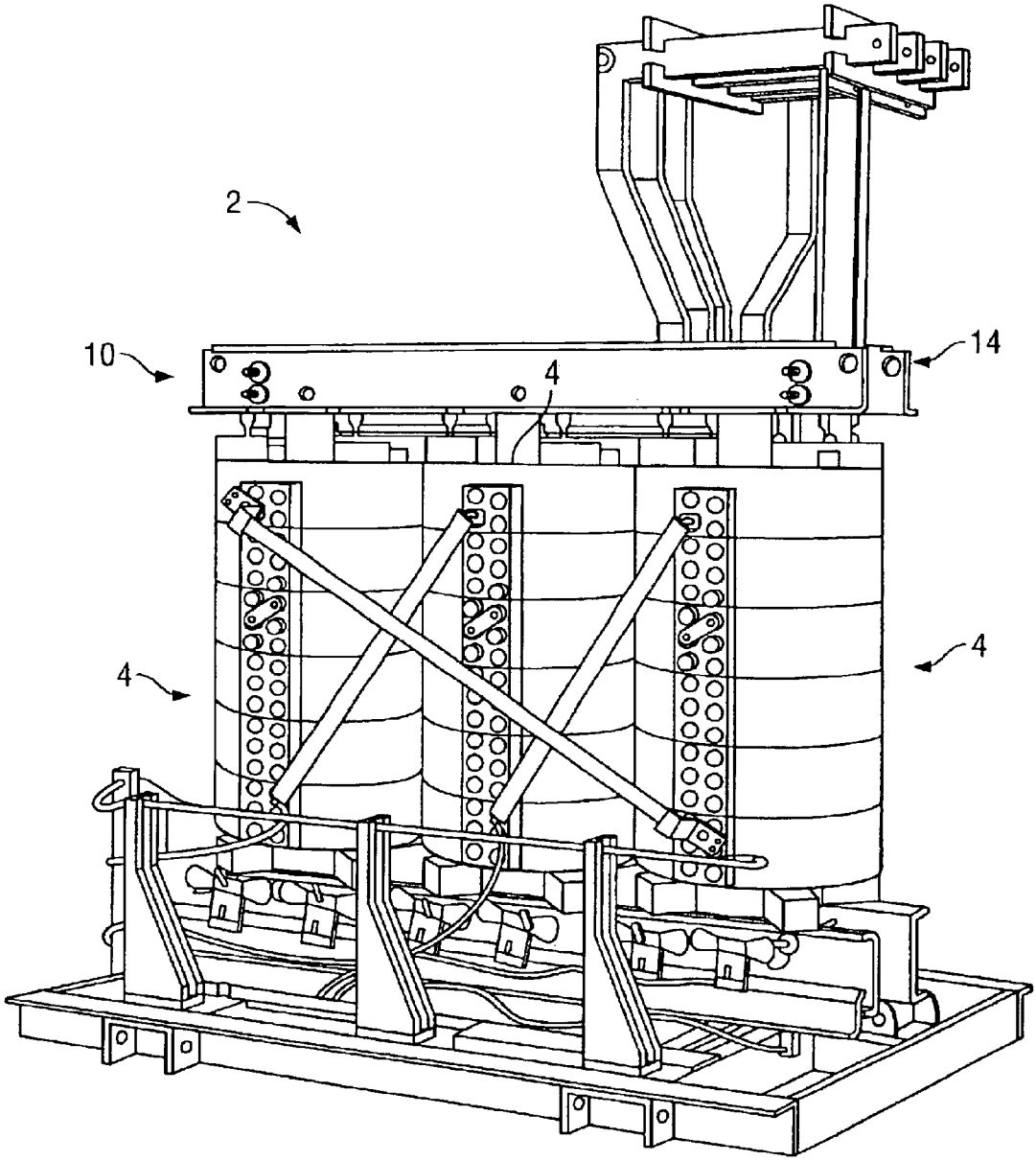
FIG. 2 is a perspective view of a cast coil transformer including winding modular sections of the present invention.

With reference to FIGS. 1 and 2, these Figures show various views of a cast coil transformer 2. This transformer 2 has three winding structures 4, and each winding structure 4 has a primary winding (coil or conductor) 6, and at least one secondary winding (coil or conductor) 8. The winding structures 4 can have a length of insulated wire (winding conductor) formed into plurality of adjacent turns defining a layer. As is well known, many layers of adjacent turns separated by insulation typically form the coils (winding). Other conductors can be used, such as a sheet or strip of metal for the windings 6, 8. As used herein, the term conductor can be defined as comprising a wire conductor, a sheet or strip of metal type conductor, or such other conductor which can be used to create a winding for a transformer. In addition to the above conventional terminology, a winding structure can include common elements such as a winding, insulators, spacers for the conductor of the winding, and other elements.

With particular focus on FIG. 1, an upper core clamp 10 is provided to firmly secure the upper core assembly including the upper core yoke 12 in position and to increase structural integrity. The upper core yoke 12 completes a core assembly and maintains position of cores within the coils. The upper core clamp 10 includes lifting holes 14 for allowing connection to a crane or other lifting devices to lift and move the overall transformer 2. Upper support blocks 16 are provided for axially supporting the coils of the winding structures 4. High voltage tap links 18 are also provided for tapping the coils, above and below normal, as one of ordinary skill in the art would understand. Low voltage (LV) leads 20 are extended from the LV (interior) coils 22 for connection to LV buswork. High voltage (HV) connections 26 are provided for connecting the three is phases of the primary transformer 2, and can be made from insulated cables supported by plastic tubes. Lower support blocks 28 are also provided for axially supporting the coils 22, 24 of the winding structures 4 and maintaining spacing between the LV and HV coils 22, 24, as shown in a molded epoxy design. A lower core clamp 30 is also provided for firmly securing the lower core assembly in position and for increasing structural integrity. Mounting feet 32 are provided for supporting the overall transformer structure and allows for a variety of standard or optional enclosures (not shown). A cruciform core 34 is assembled from core laminations and positioned as shown, as one of ordinary skill in the art would understand. The laminations are fabricated from high grade, grain oriented silicon steel. Core straps 36 tightly secure the core laminations to ensure structural and magnetic integrity.

Figure 3:
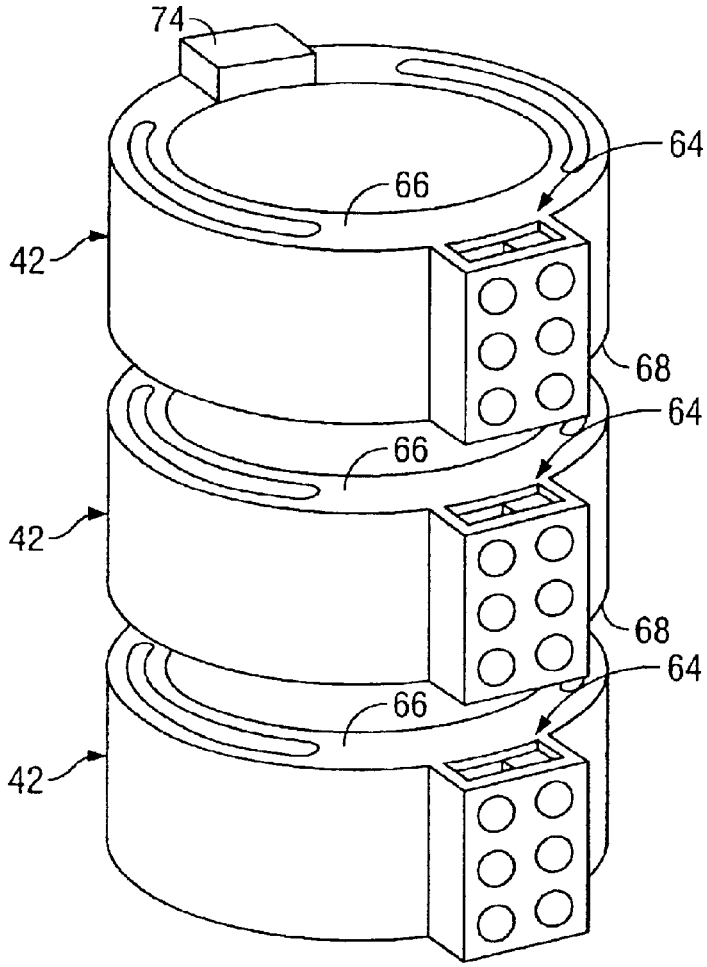
FIG. 3 is a perspective view of high voltage winding modules of the present invention.
Figure 4:
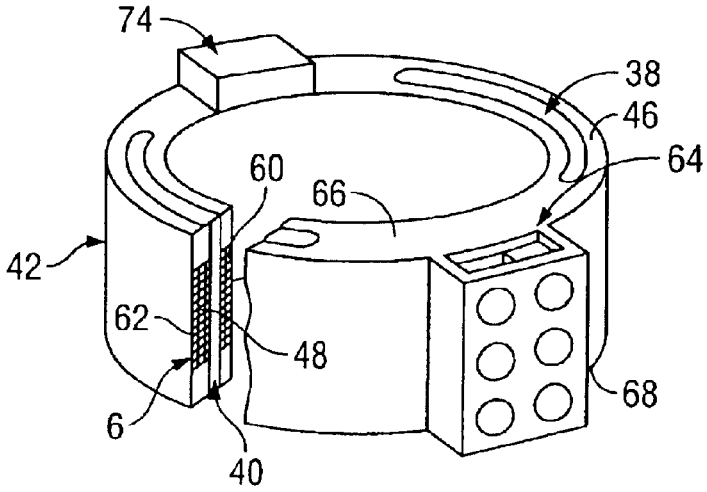
FIG. 4 is a cut away perspective view of one high voltage winding module of the present invention.

Referring to FIG. 4, primary conductors 6 are wound from aluminum, copper, or other conductor, and are vacuum impregnated and completely encapsulated in a solid dielectric. Radial air ducts 38 are provided for allowing the free-flow of air between the coil windings. Spacers 40 are used to create the radial air ducts 38. Secondary conductors 8 are wound from aluminum, copper, or other conductor sheets, and layered with pre-impregnated epoxy material. The coils are vacuum pressure impregnated, baked, and then sealed Now referring to FIGS. 2–4, each winding structure 4 of the transformer 2 of this embodiment comprises high voltage modular sections 42. In this embodiment, the transformer 2 comprises multiple modular section 42 which are wound in individual segments and separately terminated. The modular sections 42 are individually cast and electrically connected to form a complete high voltage winding that is concentrically aligned and properly spaced.

The transformer 2 of this embodiment provides capacitive coupling to make high voltage (impulse) distribution linear at high frequency (megahertz). The modular sections 42 are resin impregnated wherein the resin is impregnated into the spaces between adjacent layers insulations and foil-type conductors. This transformer 2 minimizes total resin and glass usage. Manufacturing is simplified because individual modular sections 42 can be wound on a simple winding machine then electrically coupled depending upon the specification of the transformer 2.

Each modular section 42 is positioned about a central axis, generally centered. The modular sections 42 generally comprise a support 46 and a winding 48. The support 46 is positioned about the central axis and the winding 48 comprises a conductive element located about the support 46. The winding 48 may be wound about the support, or alternatively, the winding can be wound separately prior to being positioned about the support and encapsulated with epoxy.

The support 46 comprises an inner supporting ring, an outer supporting ring, and spacer supports. The inner supporting ring is radially spaced from the outer supporting ring by the spacer supports. Radial air ducts 38 are formed between the space between the inner supporting ring and the outer supporting ring. Again, the radial air ducts 38 are provided for allowing the free-flow of air between the coil windings.

The support 46 comprises an insulating material, for example the dielectric material used to vacuum pressure impregnate, encapsulate, and seal the coils, cardboard, or any other rigid or semirigid insulting material. The support 46 can be implemented during winding of the conductive element or added later and primarily formed by the baked and hardened dielectric material. In other words, the support 46 of this embodiment is meant to define the structure of the finished modular sections 42 rather than a particular method of winding.

The winding 48 comprises an inner segment 60 and an outer segment 62. The inner segment 60 is located about the inner supporting ring. Similarly, the outer segment 62 is located about the outer supporting ring. The winding 48 is terminated at an electrical coupling 64. The electrical coupling 64 removably connects one modular section to another modular section. In other words, the modular segments are removably connected to one another such that any number of modular sections can be stacked depending upon the desired rating of the transformer.

The electrical coupling 64 is generally a plug-in type connector. However, the electrical coupling 64 is any type of electrical connector that can be readily disconnected. In the embodiment illustrated, the electrical coupling 64 is a plug-in type connector located on an upper surface 66 of the modular section 42. Another electrical coupling 64 is located on a lower surface 68. The couplings 64 are adapted to be operatively connectable with one another when the upper surface 66 of one modular section 42 is placed adjacent with the lower surface 68 of another modular section 42.

Alternatively, the electrical connection between the modular sections 44 can be accomplished via patch terminals. In this embodiment, plug-in type connectors electrically the patch terminals of one modular section 42 to terminals of another modular section 42. This allows the modular sections 42 to remain in stacked arrangement and yet not be electrically connected. This can aid in maintenance and/or ease of assembly of the transformer.

Each modular section 42 further comprises a means for properly aligning adjacent modular sections 42. When in proper alignment, the modular sections 42 are axially aligned along the central axis 44. When the modular sections 42 are properly aligned, the radial ducts 38 are in alignment from the uppermost modular section 42 to the lowermost modular section 42. The modular section 42 includes a key member 74 that extends outwardly from the upper surface 66. The lower surface 68 of the modular section 42 includes a corresponding key receiver which is adapted to receive the key member 74 to properly align the modular sections 42.

While the specific embodiment has been illustrated and described, numerous modifications come to mind without significantly departing from the spirit of the invention, and the scope of protection is only limited by the scope of the accompanying claims.

We claim:

1. An electrical transformer comprising:

a central axis;

a first modular section positioned about the central axis, the first modular section comprising a first support and a first winding of a conductive element, and a first insulating material, the first winding of a conductive element located about the first support, the first insulating material covering a portion of the first modular section;

a second modular section axially aligned with and electrically connected to the first modular section, the second modular section comprising a second support, a second winding of a conductive element, and a second insulating material, the second winding of a conductive element located about the second support, the second insulating material covering a portion of the second modular section; and, wherein the first modular section comprises a first electrical coupling, and the second modular section comprises a second electrical coupling, the first and second electrical couplings operably joined to electrically connect the first and second modular sections, the first and second electrical couplings comprising a plug-in assembly.

2. The electrical transformer of claim 1 wherein the first and second insulating materials completely encapsulate the first and second windings, respectively.

3. The electrical transformer of claim 1 wherein the first modular section and the second modular section are in stacking relationship.

4. The electrical transformer of claim 1 wherein the first and second supports comprise a solid dielectric material.

5. The electrical transformer of claim 1 wherein the first modular section comprises a key member extending outwardly therefrom for contacting a portion of the first modular section wherein the key member is provided to ensure proper axial alignment between the first and second modular sections.

6. The electrical transformer of claim 5 wherein the second modular section comprises a key receptor of receiving a portion of the key member of the first modular section.

7. The electrical transformer of claim 1 wherein the first support comprises a first inner supporting ring and a first outer supporting ring radially spaced from the first inner supporting ring, the first inner supporting ring and first outer supporting ring radially spaced by a first spacer support wherein a first radial duct is formed between the first inner and first outer supporting rings.

8. The electrical transformer of claim 7 wherein the first winding comprises a first inner segment and a first outer segment, the first inner segment located about the first inner supporting ring, and the first outer segment located about the first outer supporting ring.

9. The electrical transformer of claim 8 wherein the second support comprises a second inner supporting ring and a second outer supporting ring radially spaced from the second inner supporting ring, the second inner supporting ring and second outer supporting ring radially spaced by a second spacer support wherein a second radial duct is formed between the second inner and second outer supporting rings.

10. The electrical transformer of claim 9 wherein the second winding comprises a second inner segment and a second outer segment, the second inner segment located about the second inner supporting ring, and the second outer segment located about the second outer supporting ring.

11. The electrical transformer of claim 10 wherein the first and second radial ducts are axially aligned.

12. An electrical transformer comprising:

a first modular section comprising a first support and a first winding of a conductive element, the first winding of a conductive element located about the first support;

a second modular section separable from the first modular section, the second modular section axially aligned with and removably and electrically connected to the first modular section, the second modular section comprising a second support and a second winding of a conductive element, the second winding of a conductive element located about the second support; and, wherein the first modular section comprises a electrical coupling and the second modular section comprises a second electrical coupling, the first and second electrical couplings comprising a plug-in assembly.

13. The electrical transformer of claim 12 wherein the first and second supports comprise a solid dielectric material.

14. The electrical transformer of claim 12 wherein the first and second modular sections are in stacking relationship.

15. The electrical transformer of claim 12 wherein the first modular section comprises a first insulating material, the first insulating material covering a portion of the first modular section, and the second modular section comprises a second insulating material, the second insulating material covering a portion of the second modular section.

16. The electrical transformer of claim 15 wherein the first and second insulating materials completely encapsulate the first and second modular sections, respectively.

17. The electrical transformer of claim 12 wherein the first support comprises a first inner supporting ring and a first outer supporting ring radially spaced from the first inner supporting ring, the first inner supporting ring and first outer supporting ring radially spaced by a first spacer support wherein a first radial duct is formed between the first inner and first outer supporting rings.

18. The electrical transformer of claim 17 wherein the second winding comprises a second inner segment and a second outer segment, the second inner segment located about the second inner supporting ring, and the second outer segment located about the second outer supporting ring.

19. The electrical transformer of claim 12 wherein the first modular section comprises a key member extending outwardly therefrom for contacting a portion of the first modular section wherein the key member is provided to ensure proper axial alignment between the first and second modular sections.

20. The electrical transformer of claim 19 wherein the first winding comprises a first inner segment and a first outer segment, the first inner segment located about the first inner supporting ring, and the first outer segment located about the first outer supporting ring.

21. The electrical transformer of claim 20 wherein the first and second radial ducts are axially aligned.

22. The electrical transformer of claim 12 wherein the second modular section comprises a key receptor for receiving a portion of the key member of the first modular section.

23. The electrical transformer of claim 22 wherein the second support comprises a second inner supporting ring and a second outer supporting ring radially spaced from the second inner supporting ring, the second inner supporting ring and second outer supporting ring radially spaced by a second spacer support wherein a second radial duct is formed between the second inner and second outer supporting rings.

24. A modular section for an electrical transformer comprising a plurality of modular sections each individually electrically connected to at least one adjacent modular section, the modular section comprising:

a central axis;

a support positioned about the central axis;

a winding of a conductive element located about the support, the winding of a conductive element comprising a positive lead and a negative lead;

an electrical coupling comprising a positive terminal and a negative terminal, the positive lead electrically connected to the positive terminal and the negative lead electrically connected to the negative terminal wherein adjacent pairs of modular sections are removably and electrically connected by respective electrical couplings; and, an insulating material covering a portion of the modular section.

25. The modular section of claim 24 wherein the insulating material fully encapsulates the winding of a conductive element and the support.

26. The modular section of claim 24 wherein the support is comprised of the insulating material.

27. The modular section of claim 24 wherein the support comprises an inner supporting ring and an outer supporting ring radially spaced from the inner supporting ring, the inner supporting ring and outer supporting ring radially spaced by a spacer support wherein a radial duct is formed between the inner and outer supporting rings.

28. The modular section of claim 27 wherein the winding comprises an inner segment and an outer segment, the inner segment located about the inner supporting ring, and the outer segment located about the outer supporting ring.

29. A high voltage coil for an electrical transformer comprising:

a central axis;

a first modular section comprising:

a first support positioned about the central axis, the first support comprising a first inner supporting ring and a first outer supporting ring radially spaced from the first inner supporting ring, the first inner supporting ring and first outer supporting ring radially spaced by a first spacer support wherein a first radial duct is formed between the first inner and first outer supporting rings;

a first winding of a conductive element located about the first support, the first winding comprising a first inner segment and a first outer segment, the first inner segment located about the first inner supporting ring, and the first outer segment located about the first outer supporting ring;

a first insulating material covering a portion of the first winding of a conductive element;

a first electrical coupling;

a first alignment member comprising a key member extending outwardly from a portion of the first modular section; and a second modular section stackable with and separate from the first modular section, the second modular section axially aligned with and electrically connected to the first modular section, the second modular section comprising:

a second support positioned about the central axis, the second support comprising a second inner supporting ring and a second outer supporting ring radially spaced from the second inner supporting ring, the second inner supporting ring and second outer supporting ring radially spaced by a second spacer support wherein a second radial duct is formed between the second inner and second outer supporting rings, the second radial duct in axial alignment with the first radial duct;

a second winding of a conductive element located about the second support, the second winding comprising a second inner segment and a second outer segment, the second inner segment located about the second inner supporting ring, and the second outer segment located about the second outer supporting ring;

second insulating material covering a portion of the second winding of a conductive element;

a second electrical coupling in plug-in electrical connection with the first electrical coupling; and, a second alignment member comprising a key receptor for receiving a portion of the key member from the first modular section.

30. An electrical transformer comprising:

a central axis;

a first modular section positioned about the central axis, the first modular section comprising a first support and a first winding of a conductive element, and a first insulating material, the first winding of a conductive element located about the first support, the first insulating material covering a portion of the first modular section;

a second modular section axially aligned with and electrically connected to the first modular section, the second modular section comprising a second support, a second winding of a conductive element, and a second insulating material, the second winding of a conductive element located about the second support, the second insulating material covering a portion of the second modular section;

wherein the first modular section comprises a first electrical coupling, and the second modular section comprises a second electrical coupling, the first and second electrical couplings being operably joined to electrically connect the first and second modular sections; and, wherein the first support comprises a first inner supporting portion and a first outer supporting portion spaced from the first inner supporting portion by a first spacer support, wherein a first duct is formed between the first inner supporting portion and first outer supporting portion.

31. The electrical transformer of claim 30 wherein the first modular section comprises a key member extending outwardly therefrom for contacting a portion of the first modular section wherein the key member is provided to ensure proper axial alignment between the first and second modular sections.

32. The electrical transformer of claim 30 wherein the first modular section and the second modular section are in a stacking relationship.

33. The electrical transformer of claim 30 wherein the first modular section comprises a first key member for ensuring that the first modular section and the second modular section are in proper axial alignment prior to being electrically connected.

34. The electrical transformer of claim 33 wherein the second modular section comprises a second key member for ensuring that the second modular section is in proper axial alignment with the first modular section prior to being electrically connected.

35. The electrical transformer of claim 33 wherein the second modular section comprises a key receptor of receiving a portion of the key member of the first modular section.

36. An electrical transformer comprising:

a central axis;

a first modular section positioned about the central axis, the first modular section comprising a first support and a first winding of a conductive element, and a first insulating material, the first winding of a conductive element located about the first support, the first insulating material covering a portion of the first modular section;

a second modular section axially aligned with and electrically connected to the first modular section, the second modular section comprising a second support, a second winding of a conductive element, and a second insulating material, the second winding of a conductive element located about the second support, the second insulating material covering a portion of the second modular section; and, wherein the first modular section comprises a key member extending outwardly therefrom for contacting a portion of the first modular section wherein the key member is provided to ensure proper axial alignment between the first and second modular sections, and the second modular section comprises a key receptor for receiving a portion of the key member of the first modular section.

37. The electrical transformer of claim 36 wherein the first modular section and the second modular section are in a stacking relationship.

* * * * *